US006877333B1

(12) United States Patent
Cantolino

(10) Patent No.: US 6,877,333 B1
(45) Date of Patent: Apr. 12, 2005

(54) FILTER ASSEMBLY FOR GRAVITY-ASSISTED AIR CONDITIONER DISCHARGE WATER SAVER SYSTEMS

(76) Inventor: Christopher Ralph Cantolino, 7704 - 18th Ave. NW., Bradenton, FL (US) 34209

( * ) Notice: Subject to any disclaimer, the term of this patent is extended or adjusted under 35 U.S.C. 154(b) by 0 days.

(21) Appl. No.: 10/701,813

(22) Filed: Nov. 5, 2003

(51) Int. Cl.[7] ..... F25D 21/14; B01D 21/00

(52) U.S. Cl. ..... 62/288; 62/285; 62/291; 210/300

(58) Field of Search ..... 62/303, 285, 288, 62/291, 279; 210/268, 282, 293, 300

(56) References Cited

U.S. PATENT DOCUMENTS 6,550,264 B1 4/2003 Cantolino

*Primary Examiner*—Chen Wen Jiang
(74) *Attorney, Agent, or Firm*—Dorothy S. Morse

(57) ABSTRACT

A filter assembly for use with a gravity-assisted water saver system that sanitizes condensate from an air conditioning system with vapors released from dissolvable tablets, such as those used for treating swimming pool water or laundering purposes. It is compact and cleanable via a removable bottom cover, and it inner structure is configured to substantially reduce the likelihood of treatment vapors from the treatment chamber backing through the filter assembly and entering the connected air conditioning system from which condensate is collected. Applications can include, but are not limited to, use with systems that replenish water lost from swimming pools due to evaporation, and divert water for use in filling toilets, pressure washing, cleaning, and other gray water uses.

14 Claims, 10 Drawing Sheets

FILTER ASSEMBLY FOR GRAVITY-ASSISTED AIR CONDITIONER DISCHARGE WATER SAVER SYSTEMS

CROSS-REFERENCES TO RELATED APPLICATIONS

None

BACKGROUND OF THE INVENTION

1. Field of the Invention

This invention relates to the field of recovery devices for water extracted from the atmosphere, specifically to a filter assembly for use with gravity-assisted water saver systems, and a method for its use, that can be connected between the discharge tube of an air conditioning system and a disinfection/sanitizing treatment chamber, to collect discharged air conditioning condensate and then direct it toward the treatment chamber selected to sanitize it and thereafter divert it for constructive use. The filter assembly of the present invention has a compact configuration and connecting brace that allows it to be securely fixed against the treatment chamber during use, a removable bottom cover to facilitate maintenance, and an inner structure configured to substantially reduce the likelihood of fumes from the treatment chamber backing through the filter assembly and entering the connected air conditioning system from which the condensate was originally derived. As part of the fume blocking structure, a float ball and a valve seat are centrally positioned within the filter assembly. Applications can include, but are not limited to, use with gravity-assisted condensate treatment systems that replenish water lost from swimming pools due to evaporation, provide water to fill toilets, and/or provide water for pressure washing, cleaning, and other gray water use.

2. Description of the Related Art

Air conditioning condensate is a largely under-used resource. Typically it drips uncollected from the discharge pipe/tubing of an air conditioning system and undergoes evaporation after it is distributed on pavement or the ground. However, a significant amount of condensate is produced over time by both air conditioning systems in both residential and commercial buildings. For example, depending upon the season, a 3 to 4 ton air conditioning unit can produce up to 12–15 gallons of condensate water per day, or approximately 1,600 to 2,400 gallons per year. If 5 million homes collected the condensate produced, approximately 8 to 12 billion gallons of water per year could be recovered and put to constructive use. For 5 to 6 ton air conditioning units, up to 17–21 gallons of condensate water per unit can be produced in a day, or approximately 2,500 to 3,500 gallons per year per air conditioning unit. With the use of reclaimed water being more urgently needed and commonly accepted for an ever increasing variety of non-potable and potable uses worldwide, it would be useful to have a compact, sturdy and durable, easy-to-install, easy-to-use, low maintenance, safe, efficient, and cost effective means by which to reclaim air conditioning condensate and divert it to a useful purpose. The present invention facilitates all of these goals.

One device for gravity-assisted recovery and treatment of air conditioning condensate is the invention disclosed in U.S. Pat. No. 6,550,264 to Cantolino (2003). It has a treatment chamber configured for holding a stack of chlorine tablets used for treating swimming pool water, or the type of bleach tablet used for laundry purposes, and an external P-trap connected between its water inlet opening and the air conditioning system from which the recovered water is derived that is configured to prevent the corrosive treatment vapors released by such tablets from entering the associated air conditioning system. Ridges in the slanted bottom surface of the treatment chamber provide support for the tablets above the condensate as it flows toward the chamber's discharge opening. The condensate does not come into actual contact with the tablets. The ridges are positioned to laterally divert the condensate flow, to increase the amount of time that the condensate is exposed to the treatment vapors for effective elimination of algae, mold, bacteria, viruses, and other disease causing agents. The slanted bottom surface causes the condensate to continue to move toward the chamber's discharge opening. In addition, a removable cap connected to the top of the treatment chamber serves a dual purpose. It allows convenient access to the chamber for introduction of new treatment tablets, and it also prevents the corrosive treatment vapors released from those tablets from inadvertently entering the atmosphere. The present invention is configured as an addition to, or replacement for, the external P-trap of the 2003 Cantolino system, and provide a sturdy, compact, and easily maintained filter assembly that prevents corrosive vapors in the treatment chamber from backing up and entering the air conditioning from which the condensate subjected to sanitizing treatment process is derived.

BRIEF SUMMARY OF THE INVENTION—OBJECTIVES AND ADVANTAGES

The primary object of this invention is to provide a filter assembly for use with a gravity-assisted condensate sanitizing system that uses treatment tablets capable of releasing corrosive vapors, which protects the air conditioning system from which the condensate is derived from such vapors while the condensate is being treated and diverted for constructive use. It is also an object of this invention to provide a filter assembly for a condensate sanitizing system that has a sturdy construction, is compact in size, and is made from durable materials. A further object of this invention is to provide a filter assembly for a condensate sanitizing system that can be promptly, easily, and securely installed adjacent to the treatment chamber of the sanitizing system. It is also an object of this invention to provide a filter assembly for a condensate sanitizing system that has multiple internal means for preventing vapors in the treatment chamber from backing up and reaching the air conditioning system from which the condensate was derived. It is a further object of this invention to provide a filter assembly for a condensate sanitizing system that can be easily installed in new construction, as well as retrofitted to air conditioning systems in existing construction.

As described herein, properly manufactured and used, the present invention is a filter assembly for a gravity-assisted water recovery system that takes the bacteria-laden and algae-laden discharge from a building air-conditioning system, and treats it with sanitizing vapors so that it can be used for other applications, such as but not limited to swimming pool refill. The most preferred embodiment of the present invention has a compact and sturdy housing within which two internal P-traps are formed. The first P-trap encountered by the air conditioning condensate collected for treatment is large and formed in part by a removable cover connected to the bottom of the filter assembly housing. The second P-trap is much smaller and positioned within the upper half of the filter assembly housing. A connecting brace attached to the upper surface of the filter assembly housing has a protuberance that contributes to the second P-trap structure. Between the two P-traps, the most preferred embodiment also contains a float ball and valve seat combination whereby when the water level within the filter assembly is below the valve seat, the gravity secures the float ball within the valve seat to block any treatment fumes from reaching the connected air conditioning system from which the condensate was collected. Once the amount of collected condensate is sufficient to again lift the float ball, movement of collected condensate is again allowed to flow into the smaller P-trap, and subsequently into the treatment chamber. The present invention filter assembly is compact in construction with a housing configured and manufactured for protecting its internal structure from potentially damaging contact with yard maintenance equipment, as well as premature failure due to deterioration brought about by exposure to weathering elements, such as the sun. Also, the distal end of the connecting brace secured to the top portion of the filter assembly housing is configured for stable positioning against the outer wall of treatment chamber with which the present invention is to be used. Thus, when the treatment chamber used with the present invention is cylindrical, the distal end of its connecting brace would have a complementary concave configuration. Connection of the present invention between an air conditioning system and requires minimal effort and expense. The inlet opening in the filter assembly is connected to the air conditioning discharge tubing, and the discharge opening of the treatment chamber is placed in fluid communication with the inlet opening of a gravity-assisted treatment chamber. Since the treatment chamber housing is typically secured to a stationary object or fixture, such as a wall, through use of a mounting bracket, the sturdy connection of the present invention to the treatment chamber provides stable positioning for both devices. Maintenance for the present invention is easy, requiring only the periodic removal of the bottom cover for inspection and/or cleaning. Since the present invention filter assembly housing is small in size, it can be easily, promptly, and inexpensively installed with air conditioning systems in new construction, or retrofitted into existing construction, thereby making recovery of a previously wasted source of water possible at a low cost to the user.

While the description herein provides preferred embodiments of the present invention, it should not be used to limit its scope. For example, variations of the present invention, while not shown and described herein, can also be considered within the scope of the present invention, such as variations in the size of the float ball and valve seat, as long as together they can effectively fulfill their fume blocking function; the type of connection means used to attach the removable cover to the filter assembly housing; the optional use of an o-ring or gasket to provide a waterproof seal between the removable cover and the filter assembly housing; the cross-sectional configuration of the filter assembly housing; the thickness of the internal and external walls in the filter assembly housing; the type of vapor-resistant material used to manufacture the filter assembly housing, float ball, and removable cover; and the surface texture, markings, instructions, logos, and other characteristics of the outside portion of filter assembly housing. Thus, the scope of the present invention should be determined by the appended claims and their legal equivalents, rather than being limited to the examples given.

DETAILED DESCRIPTION OF THE INVENTION

Figure 1:
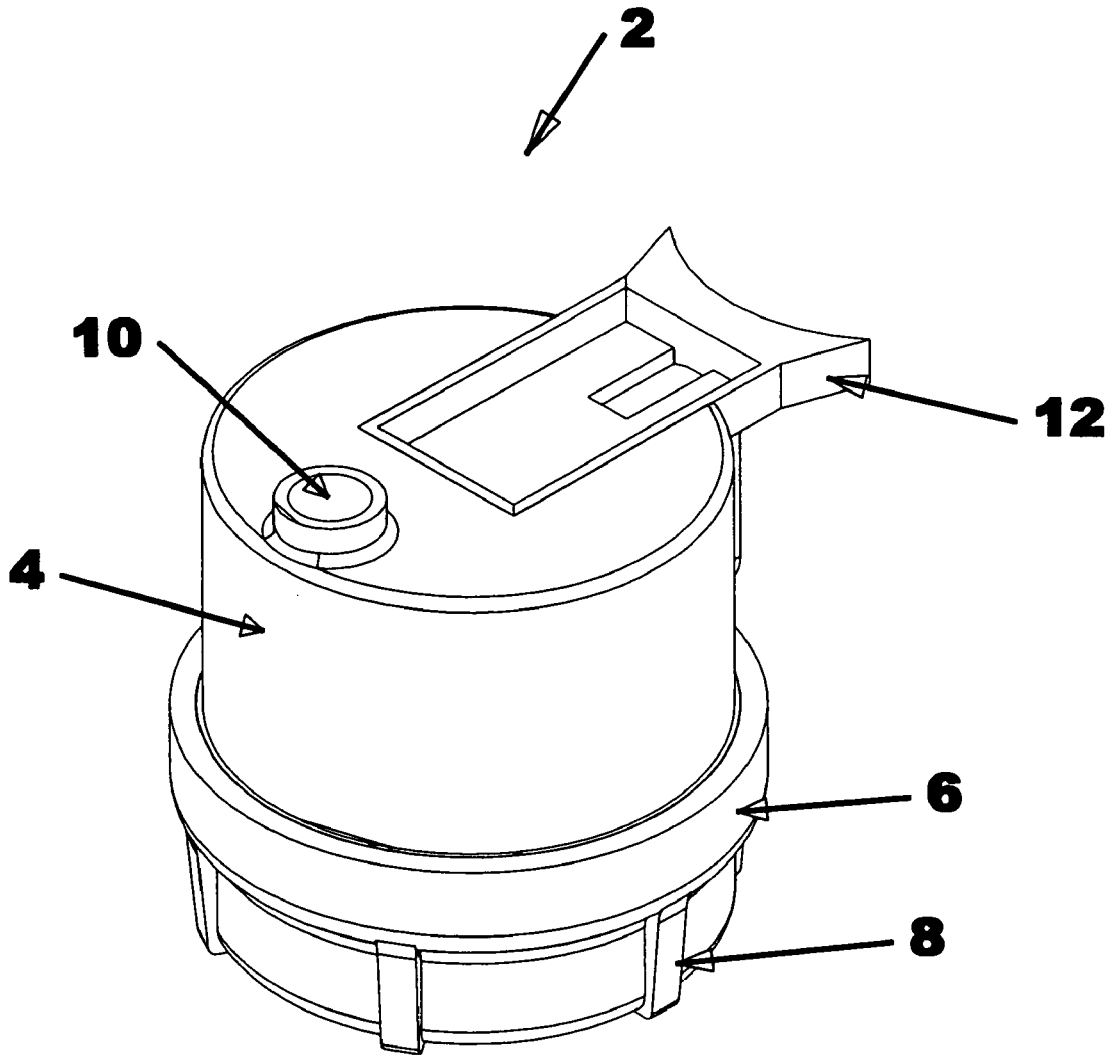
FIG. 1 is a perspective side view of the most preferred embodiment of the present invention having a cylindrical housing with an upper inlet opening, a removable bottom cover with ridges that assist in its rotation/removal, and a connecting brace configured for use in securely positioning the housing against a gravity-assisted condensate treatment chamber.
Figure 2:
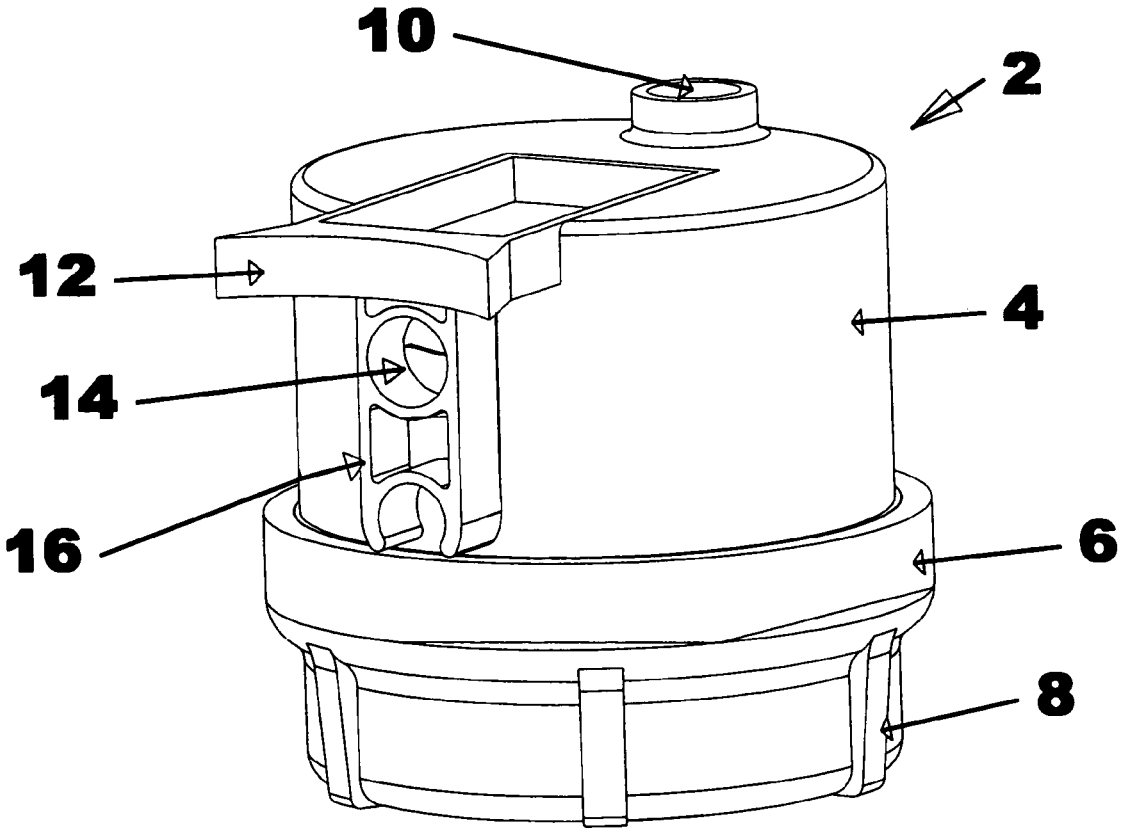
FIG. 2 is a perspective front view of the most preferred embodiment of the present invention shown in FIG. 1, with the discharge opening through the upper portion of the housing also visible and shown in a position directly under the connecting brace.
Figure 12:
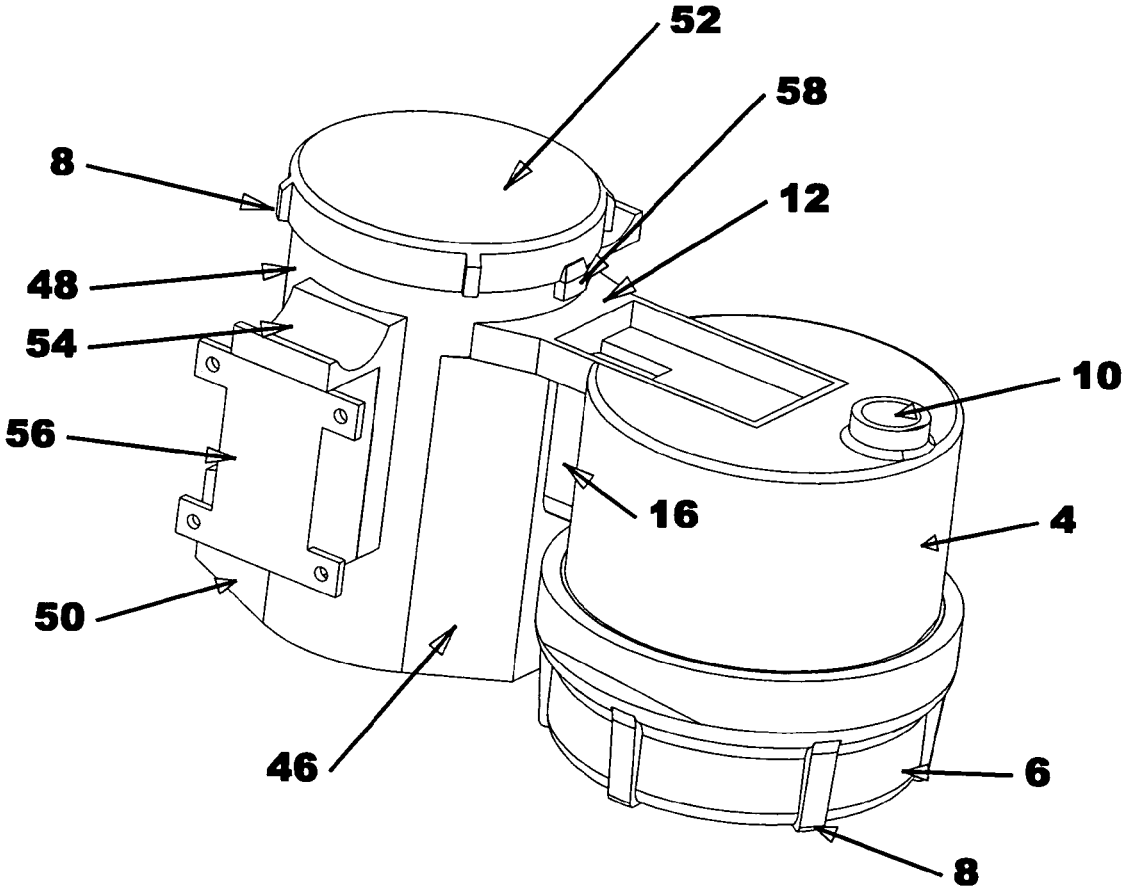
FIG. 12 is a perspective view of the most preferred embodiment of the present invention connected to a gravity-assisted air conditioning condensate treatment chamber with its discharge opening in a position lower than and remote from the present invention.

FIGS. 1 and 2 show the most preferred embodiment 2 of the present invention filter assembly having a cylindrical housing 4 with an upper inlet opening 10, a removable bottom cover 6 with ridges 8 that assist in its rotation/removal, and a horizontally-extending connecting brace 12 configured for securely positioning housing 4 against a gravity-assisted treatment chamber, such as chamber 48 shown in FIG. 12. In addition, FIG. 2 shows the discharge opening 14 in housing 4 being surrounded by a verticallyextending attachment member 16 that is attached to the outside surface of housing 4 directly under connecting brace 12. The distal end of connecting brace 12 (identified by the number 30 in FIG. 5) has a concave configuration configured to securely place housing 4 in a fixed/stable position against the cylindrical outer surface of the treatment chamber 48 shown in FIG. 12. Should the outer surface of the sanitizing/treatment chamber selected for use with most preferred embodiment 2 have an outer surface configuration other than cylindrical, the configuration of distal end 30 would be modified during manufacture to complement it. The size of housing 4 can be varied according to size of the associated air conditioning system from which it will collect condensate so as to allow continued flow of condensate through treatment chamber 48 and an optimum amount of exposure time of the condensate to the vapors released from the tablets in the connected treatment chamber 48. FIGS. 1 and 2 show inlet opening 10 through the top surface of filter assembly 4, in a position remote from discharge opening 14, and also in an elevated position relative to discharge opening 14. Although the location of inlet opening 10 through the top surface of filter assembly 4 and its remote positioning from discharge opening 14 are not critical and could vary according to the internal P-trap structure of housing 4, since most preferred embodiment 2 becomes a part of a gravity-assisted flow system when it is connected to treatment chamber 48, inlet opening 10 must always be in an elevated position relative to discharge opening 14 for efficient flow of condensate from housing 4 and into treatment chamber 48. Further, the diameters of inlet opening 10 and discharge opening 14, relative to one another and housing 4, may vary from that shown in FIGS. 1 and 2 as long as the means of connection for inlet opening 10 to the condensate discharge pipe (not shown) of an air conditioning system and discharge opening 14 to treatment chamber 48 the remains simple and expedient. To reduce maintenance during use of preferred embodiment 2, housing 4, bottom cover 6, and connecting brace 12 are all made from sturdy corrosion-resistant materials that would also be configured for protection against premature deterioration from weathering elements, such as the sun. Although not shown, an o-ring or other gasket means may be positioned between housing 4 and bottom cover 6, as needed, to assist in achieving a leak-proof connection therebetween when the two are joined for condensate collection use. The configurations of connecting brace 12 and attachment member 16 are not critical and may be varied from that shown in FIGS. 1 and 2. Further, although the bottom cover 6 in most preferred embodiment 2 is shown to have six ridges 8 (see also FIG. 4), the number, shape, and dimension of ridges 8 are not critical as long as they facilitate hand-manipulation of bottom cover 6.

Figure 3:
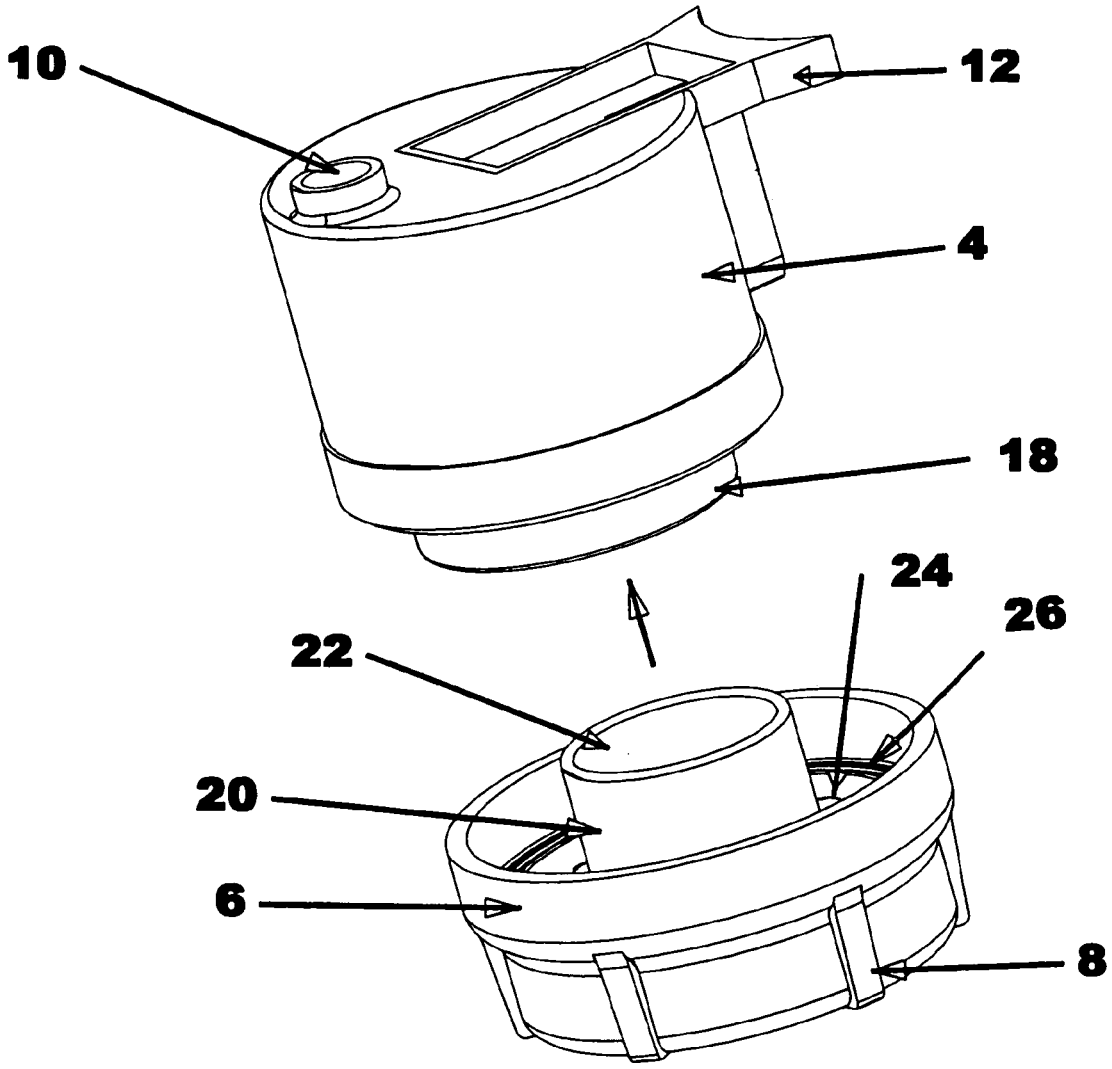
FIG. 3 is an exploded view of the most preferred embodiment of the present invention with its bottom cover removed to reveal a threaded connection, as well as upwardly extending and downwardly extending internal components that create a first P-trap.
Figure 4:
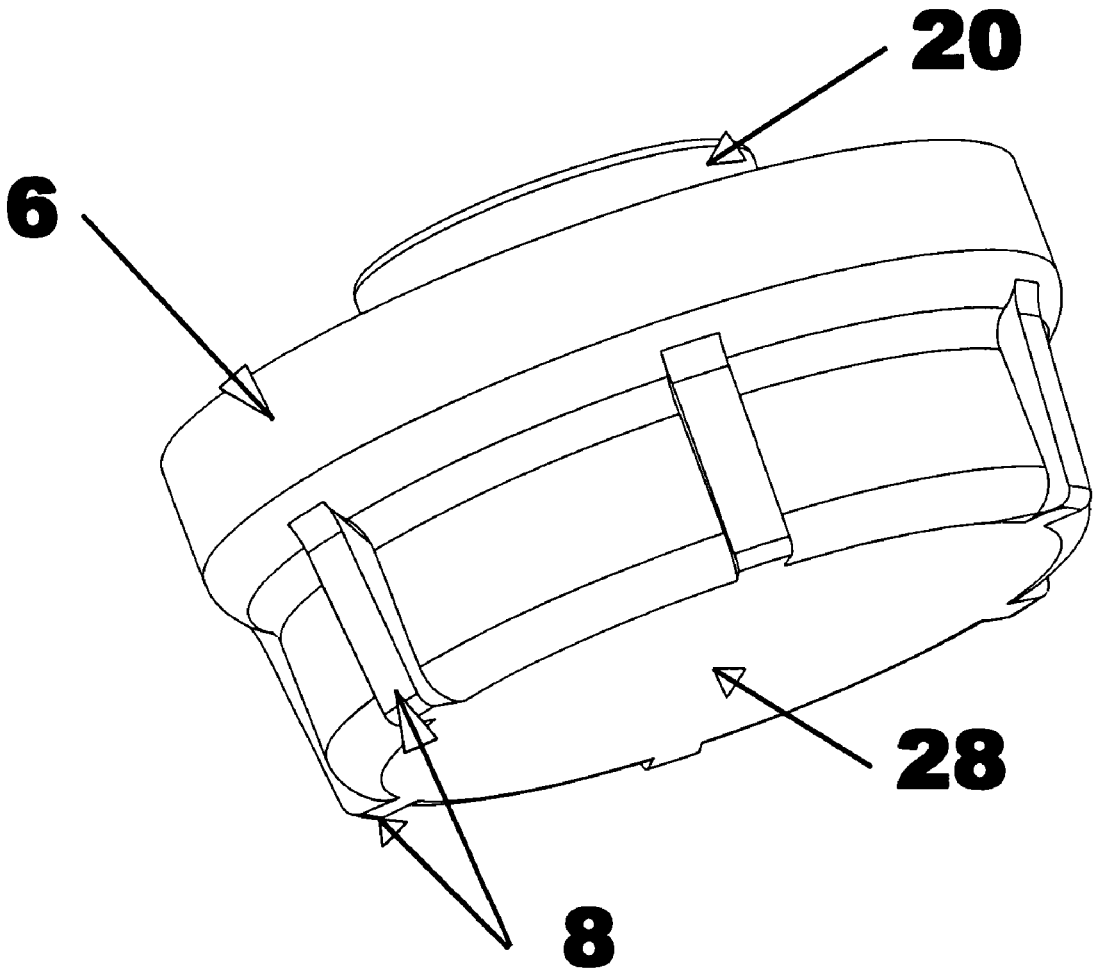
FIG. 4 is a bottom perspective view of the bottom cover in the most preferred embodiment of the present invention showing its ridges and unadorned bottom surface.
Figure 9:
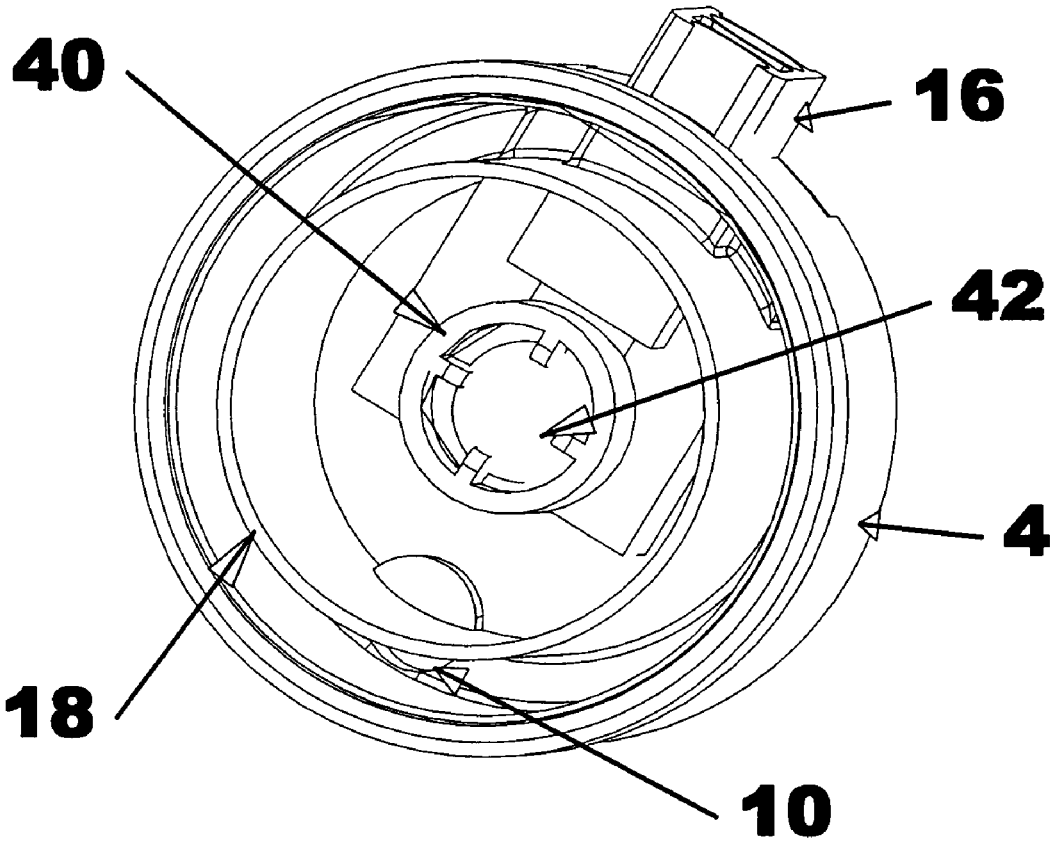
FIG. 9 is a bottom view of the housing in the most preferred embodiment of the present invention having a float ball valve and valve seat centrally positioned within the housing and concentric with the downwardly-extending cylindrically-shaped internal wall structure.

FIGS. 3 and 4 show bottom cover 6 removed from housing 4. In addition, FIG. 3 shows housing 4 with its upper inlet opening 10 and horizontally-extending connecting brace 12 poised above bottom cover 6 and ready for connection thereto. FIG. 3 further shows bottom cover 6 having a plurality of threads 26 adjacent to bottom surface 24, used for connection of bottom cover 6 to the lower end of cylindrical housing 4. The complementary threaded configuration on the lower end of housing 4 needed for connection to threads 26 is not visible in FIG. 3. The use of threads 26 for connection between housing 4 and bottom cover 6 is not critical, and other means of secure connection between them are also considered to be within the scope of the present invention although not shown, including but not limited to a bayonet lock or clamping connection as long as the means used allows for easy and prompt maintenance access to housing 4. FIGS. 3 and 4 also show a cylindrical internal wall structure 20 centrally positioned within bottom cover 6, and upwardly extending therefrom, which provides part of the structure of a first P-trap in the most preferred embodiment 2. The central opening 22 within cylindrical internal wall structure 20 is where the float ball 40 and valve seat 42 (shown in FIG. 11) are positioned in the most preferred embodiment 2. The inner wall 18 downwardly extending from housing 4, shown in FIG. 3, is also another part of the first P-trap in most preferred embodiment 2, as is the inside bottom surface 24 of bottom cover 6. The upwardly directed arrow in FIG. 3, between wall structure 20 and the inner wall 18 of housing 4, indicates that wall structure 20 will be inserted within inner wall 18 when bottom cover 6 and housing 4 are joined. As shown in FIG. 9, once bottom cover 6 and housing 4 are joined in most preferred embodiment 2, wall structure 20 becomes concentrically positioned within inner wall 18. While concentric positioning is preferred, it is not critical. Since FIG. 4 is an enlarged view of bottom cover 6 it shows the configuration of ridges 8 in greater detail that the other illustrations provided herein. Although the configuration of ridges 8 shown in FIG. 4 is preferred for manufacturing, functional, and aesthetic reasons, it is not critical as long as ridges 8 assist in the easy removal/attachment of bottom cover 6 to the lower end of housing 4. Further, while FIG. 4 shows the outside bottom surface 28 of bottom cover 6 being planar and unadorned, bottom surface 28 may be textured, have marked indicia thereon such as but not limited to product source information or instructions for assembly and/or use, have one or more concentric rings downwardly depending therefrom if needed to raise the height of discharge opening 14 for a simpler and more direct connection to a treatment chamber 48 having a different configuration from that shown in FIG. 12, or have another change from that shown which provides aesthetic or functional advantage while still promoting a stable positioning for housing 4 relative to treatment chamber 48.

Figure 5:
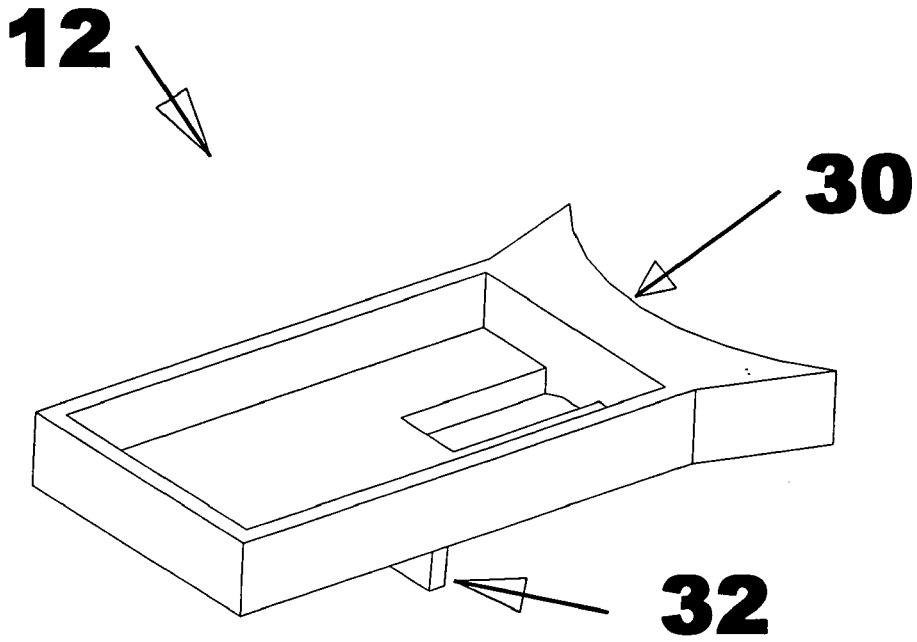
FIG. 5 is a top perspective view of the connecting brace in the most preferred embodiment of the present invention having a curved distal end and a downwardly depending protuberance.
Figure 6:
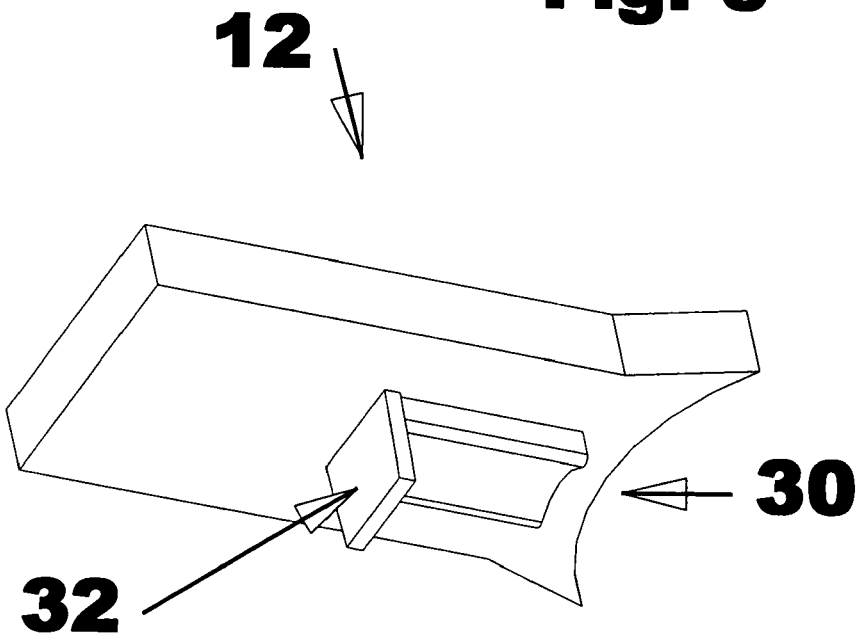
FIG. 6 is a bottom perspective view of the connecting brace shown in FIG. 5.

FIGS. 5 and 6 show connecting brace 12 in the most preferred embodiment 2 of the present invention having an elongated and horizontally-extending configuration, a concave distal end 30, and a protuberance 32 centrally and downwardly depending from its bottom surface. Further, as can be seen in FIG. 6, protuberance 32 has an L-shaped structure, with the elongated portion of the L-shape (not numbered) being used to attach the downwardly depending short portion of protuberance 32 in place against the bottom surface of connecting brace 12. As shown in FIG. 6, the elongated portion of protuberance 32 is positioned so that it extends toward concave distal end 30 and provides the upper portion of the second elevated P-trap within housing 4 when the rectangular end of connecting brace 12 remote from distal end 30 is secured within the substantially rectangular recess 62 shown in the upper surface of housing 4 in FIG. 7. Protuberance 32, in combination with the upwardly extending partition 38 shown in FIG. 7, also form a part of the second elevated P-trap in most preferred embodiment 2. Although the configuration of connecting brace 12 could vary from that shown in FIGS. 5 and 6, such as but not limited to the corners on the rectangular end of connecting brace 12 being rounded, its distal end 30 must still conform to the configuration of the outside surface of treatment chamber 48 and its opposing end must be configured to fit securely within the rectangular or other perimeter outline defined by recess 62. Further, although not shown, it is considered to be within the scope of the present invention for connecting brace 12 to be permanently attached to housing 4 during manufacture with adhesive or other bonding means, or in the alternative, for connecting brace 12 to be removably attached to housing 4 for easy maintenance access to the second elevated P-trap in housing 4. Since the condensate flow through housing 4 is gravity-assisted and subject to the pressure of a pump, connecting brace 12 could have a sliding or snap-fit attachment within recess 62 as long as a leak proof connection is made that does not interrupt condensate flow through housing 4. As can be seen in FIG. 12, connecting brace 12 is placed into a substantially horizontally-extending position during use.

Figure 7:
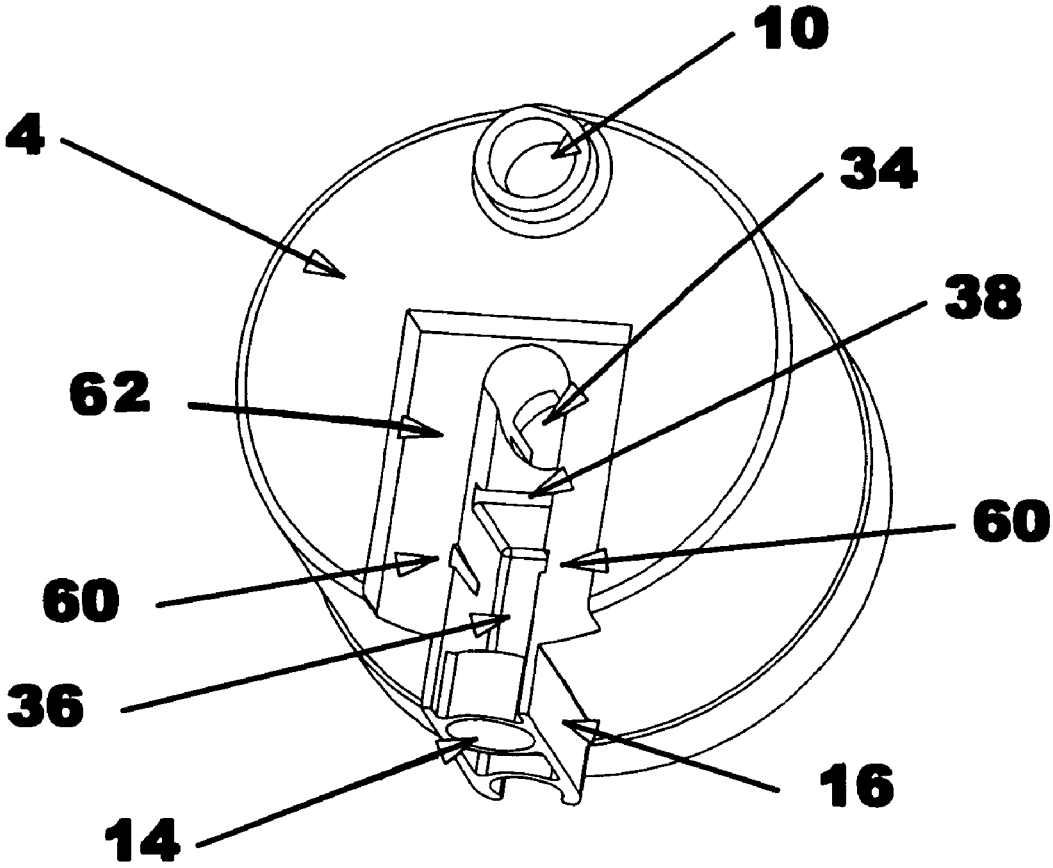
FIG. 7 is a top perspective view of the housing in the most preferred embodiment of the present invention having a discharge opening and an upper configuration adjacent to the discharge opening that comprises part of an elevated P-trap.
Figure 8:
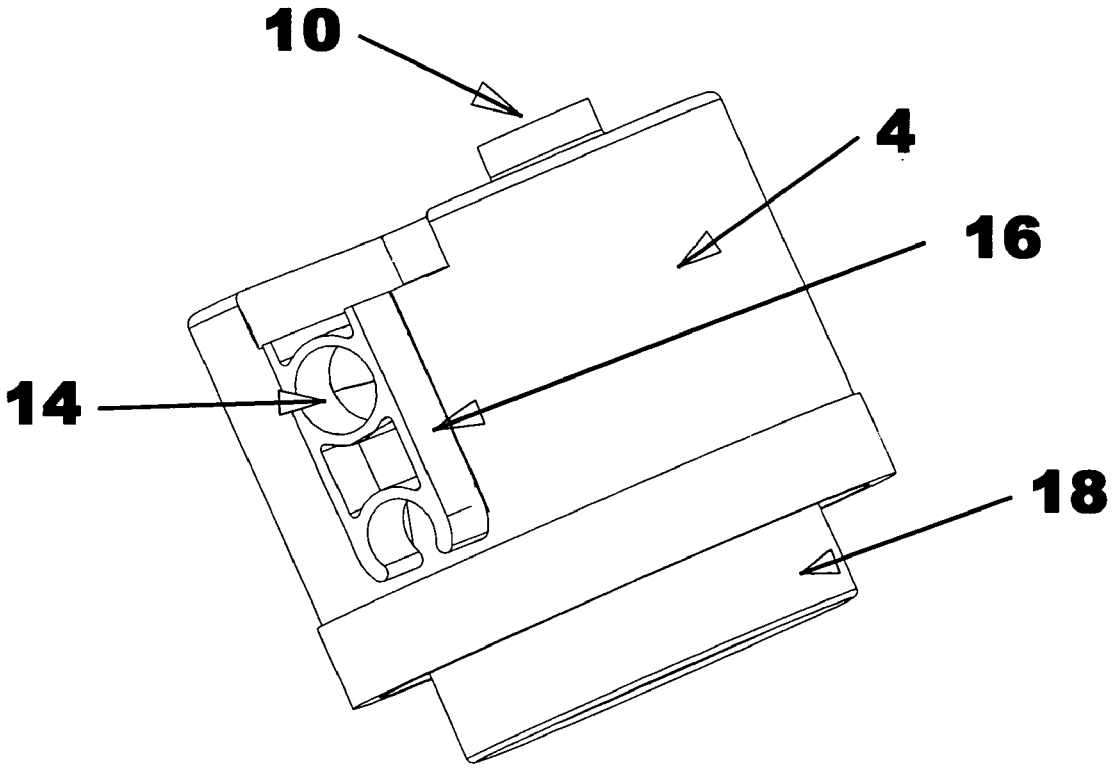
FIG. 8 is a perspective side view of the housing in the most preferred embodiment of the present invention shown in FIG. 7, with the downwardly-extending cylindrically-shaped internal wall structure that forms part of the first P-trap.

FIGS. 7 and 8 show the discharge opening 14 in the most preferred embodiment 2 of the present invention connected to an attachment structure 16 that provides and protects fluid communication between housing 4 and treatment chamber 48. The inside diameter of discharge opening 14 can be sized to permit insertion of a common size of conduit (not shown) between housing 4 and the vertical channel 46 provided on the inlet side of treatment chamber 48 to direct the condensate collected by housing 4 toward the angled bottom surface of treatment chamber 48 for exposure to sanitizing fumes. In the alterative, attachment structure can be directly bonded or otherwise connected to vertical channel 46 for leak proof transfer of collected condensate. The structure of attachment member 16 above and below discharge opening 14 is not critical. However, the part of attachment member 16 above discharge opening 14 must complement the configuration at the end of the elongated portion of the L-shaped protuberance 32 to provide a leak proof fit, and the part of attachment member 16 below discharge opening 14 must have a sufficient length dimension to provide a stable connection and/or interface between attachment member 16 and vertical channel 46. Although FIG. 7 shows inlet opening 10 in a position remote from discharge opening 14, such positioning is not critical as long as the condensate entering housing 4 is directed through the contemplated internal P-trap and valve seat configurations with housing 4. FIG. 7 also shows notches 60 that guide the protuberance 32 downwardly extending from connecting brace 12 into its usable position and hold it securely in place during use, whereby the underside surface of connecting brace 12, protuberance 32, upwardly extending partition 38, and the deep central bottom surface 36 of recess 62 together form the second elevated P-trap in housing 4. Access opening 34 provides a means of fluid communication between the valve seat 42 (shown in FIG. 9) and the second elevated P-trap in the upper portion of housing 4. In addition, FIG. 8 shows the inner wall 18 within housing 4 that surrounds valve seat 42 and provides a part of the first P-trap structure within the lower portion of housing 4 and bottom cover 6 when bottom cover 6 is joined to housing 4 and ready for condensate collection use.

Figure 10:
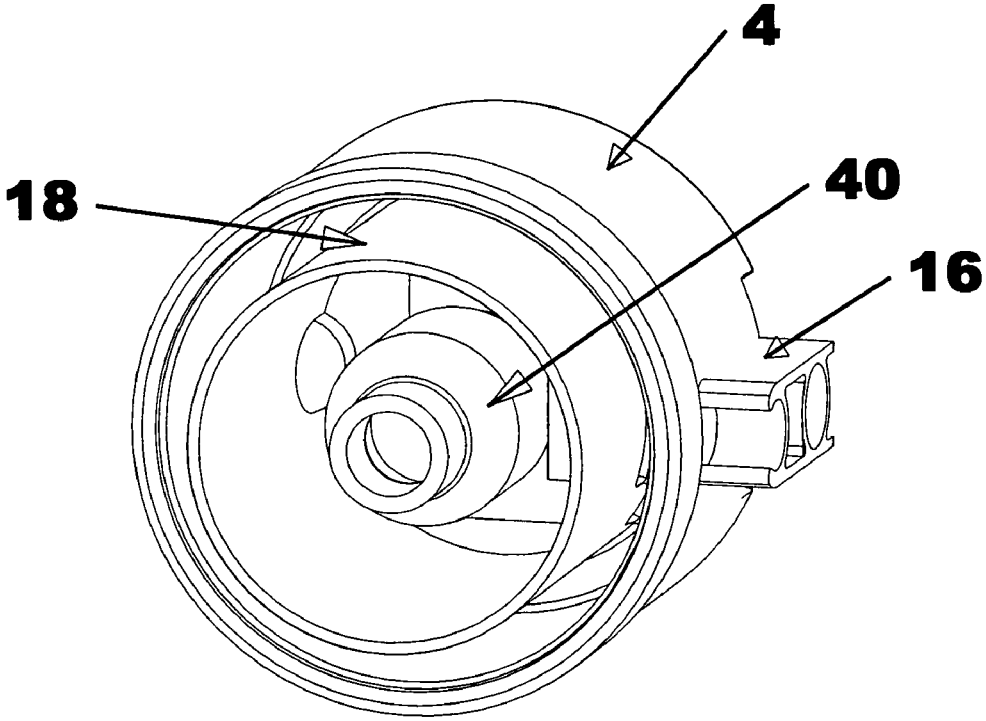
FIG. 10 is a bottom perspective view of the housing in the most preferred embodiment of the present invention and the valve seat centrally positioned therein.
Figure 11:
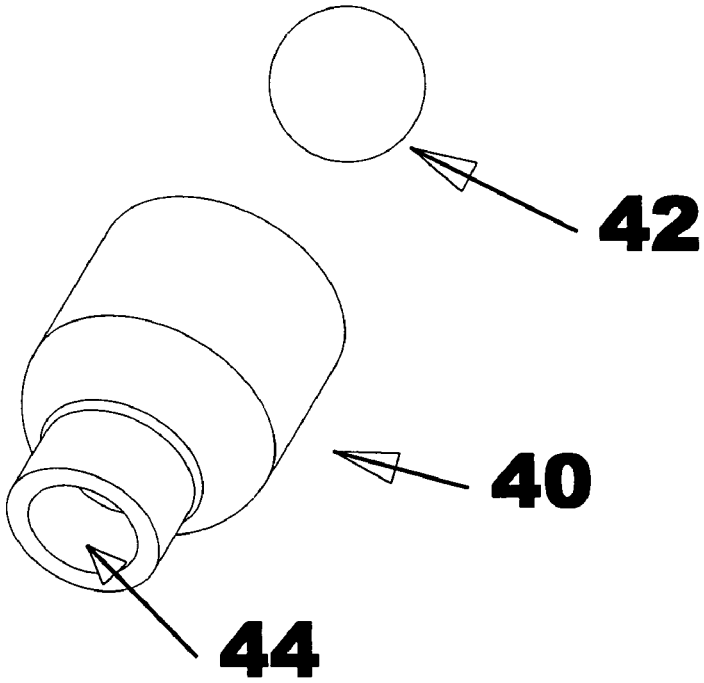
FIG. 11 is a perspective view of the float ball valve and valve seat in most preferred embodiment of the present invention.

While FIG. 11 shows the relative proportion and size dimension of float ball 42 and valve seat 40 in most preferred embodiment 2 of the present invention, FIGS. 9 and 10 show the bottom end of housing 4 and the central placement of valve seat 40 therein, with FIG. 9 further showing float ball 42 centrally positioned within valve seat 40. Although not marked with a number, the multiple concentric lines shown on the bottom end of the outer wall of housing 4 in FIGS. 9 and 10 indicate the complementary threaded configuration used with the threads 26 shown on the inside surface of the outer wall of bottom cover 6 for the secure and leak proof connection required between bottom cover 6 and housing 4. FIGS. 9 and 10 also both show valve seat 40 centered within cylindrical inner wall 18, and inlet opening 10 positioned remote from attachment structure 16, through which discharge opening 14 is placed in fluid communication with the tablet-holding treatment chamber 48 secured to housing 4 and used for sanitizing treatment of the air conditioning condensate collected by the most preferred embodiment 2. FIG. 11 shows the bore 44 through the lower end of valve seat 40 through which collected condensate travels to unseat float ball 42, which then allows the collected condensate to flow into the second P-trap formed by the bottom surface 36 formed in the upper surface of housing 4, the underside surface of connecting brace 12, protuberance 32, and partition 38, and finally into the vertical channel 46 leading into treatment chamber 48. Until forced away from valve seat 40 by the accumulation of collected condensate within the first P-trap in housing 4, gravity forces float ball 42 into the interior space within valve seat 40 so that float ball 42 covers bore 44 and prevents back-flow of treated condensate through the first P-trap and into the associated air conditioning system (not shown) from which the condensate is collected. The cross-sectional inside dimension of valve seat 40 should not be significantly larger that the diameter dimension of float ball 42, so that when conduit flow through the second elevated P-trap access opening 34 has ceased, float ball 42 will always seek a centered position within valve seat 40 over bore 44 to block it.

FIG. 12 shows most preferred embodiment 2 of the present invention connected to a gravity-assisted air conditioning condensate treatment chamber 48. Removable bottom cover 6 with ridges 8 is attached to the bottom end of housing 4 and connecting brace 12 extends from housing 4 so that its distal end 30 is in contact with the outer surface of treatment chamber 48 above vertical channel 46. In a vertical direction, distal end 30 is secured against upward movement by tab 58, and from downward movement by vertical channel 46. In the alternative and depending upon the intended application of the present invention, connecting brace 12 may be permanently attached to housing 4 and treatment chamber 48, or removable therefrom to provide maintenance access to the second elevated P-trap within housing 4. FIG. 12 shows attachment member 16 in a sandwiched position between housing 4 and vertical channel 46, that establishes fluid communication for the collected conduit between the discharge opening 14 in housing 4 and treatment chamber 48. Although not shown, a piece of conduit can be used to secure leak proof fluid communication between the discharge opening 14 extending through attachment member 16 and the vertical channel 46 connected to treatment chamber 48. FIG. 12 further shows bottom cover 6 having ridges 8 to assist in its removal from housing 4, the number of ridges 4 used not being critical, and the inlet opening 10 through the upper surface of housing 4 in a position remote from treatment chamber 48. The positioning of inlet opening 10 shown in FIG. 12 is not critical, and may vary if the internal structure of housing 4 is also similarly varied to allow the flow of collected condensate in the contemplated sequence through the combination of P-traps and/or valve seats positioned within housing 4. FIG. 12 also shows treatment chamber 48 having a cap 52 with ridges 8, which is removed periodically to renew the supply of condensate-sanitizing tablets used within treatment chamber 48. In addition, FIG. 12 shows treatment chamber 48 having two opposed external mounting supports 54 outwardly depending from its outside surface, with a mounting bracket 56 attached to one of the supports 54. Mounting bracket 56 can be used to secure treatment chamber 48 to a fixed surface, such as a wall, for additional stabilization of both treatment chamber and the attached housing 4. The discharge assembly in the lower end of treatment chamber 48 and positioned remote from vertical channel 46, is designated in FIG. 12 by the number 50. Although it is contemplated for the treatment chamber 48 in most preferred embodiment 2 to have a circular cross-sectional configuration and a dimension only slightly larger that the sanitizing tablets (not shown) envisioned for use therewith, the cross-sectional configuration of filter assembly housing 4 is not limited to the cylindrical configuration shown in FIG. 12. However, when should the outer surface of housing 4 be changed, the distal end 30 of connecting brace 12 would also be appropriately modified to continue to allow a close contact between distal end 30 and treatment chamber 48. The internal structure of vertical channel 46 attached to treatment chamber 48 is configured to provide a means through which collected condensate can reach the inclined inside bottom surface of treatment chamber 48 without coming into direct contact with the stacked tablets (not shown) positioned within treatment chamber 48 above the inclined bottom surface, which produce the needed treatment vapor for sanitizing the condensate before it is released and diverted for a useful purpose. To reduce maintenance, filter assembly housing 4, connecting brace 12, and bottom cover 6 are made from sturdy corrosion-resistant materials that also would be configured for protection against premature deterioration by weathering elements, such as the sun. While the number of P-traps and valve seats within housing 4 are not critical, at least one P-trap in combination with at least one float ball 42 and valve seat 40 are contemplated for use with the present invention.

Although the internal structure of treatment chamber is not shown, typically to use the present invention, a user would place at least one sanitizing fume-producing tablet (not shown) within treatment chamber 48. A removable basket may be used within treatment chamber 48 to more conveniently introduce tablets into the required position above the inclined bottom surface of treatment chamber 48 where the collected condensate travels during exposure to the treatment fumes. Under routine operation, one or two tablets will permit annual refill maintenance. The basket or bottommost tablet sits upon a series of laterally-extending ridges on the inclined bottom surface between which the condensate flows while being sanitized. The present invention collects the condensate prior to its transfer to the treatment chamber 48 and exposure to the sanitizing fumes. The condensate leaving the air conditioning discharge pipe first enters the present invention via inlet opening 10. Gravity draws the condensate directly to the bottom surface 24 of bottom cover 6 between the inside surface of the outside wall of housing 4 and inner wall 18. Inner wall 18 does not extend all the way to bottom surface 24 when housing 4 and bottom cover 6 are joined. The collected condensate accumulates within bottom cover 6 until a sufficient amount is obtained for some of it to spill over into the central opening 22 within the cylindrical internal wall structure 20 that upwardly extends from bottom surface 24 and into which valve seat 42 is suspended. Float ball 40 is positioned within valve seat 42, until sufficient condensate accumulates and flows through the bottom opening 44 in valve seat 42, and then forces float ball 40 upward and away from valve seat 42 so as to allow the condensate to eventually move upwardly and into the elevated second P-trap of housing 4 through internal access opening 34 (shown in FIG. 7). Once a sufficient amount of condensate moves through access opening 34 so that it spills over upwardly extending partition 38, the condensate moves under protuberance 32, across the deep central bottom surface 36 of recess 62, and through discharge opening 14. In the most preferred embodiment of the present invention, the sanitizing fumes released by the tablets in treatment chamber 48 are prevented from reaching the air conditioning system from which the condensate was derived, since the fumes would be dissolved by the condensate accumulated in the P-traps within housing 4, and if the amount of condensate within housing 4 is low, float ball 42 would be firmly seated by gravity against valve seat 40 to prevent fumes from traveling through its bottom opening 44 and the lower end of housing 4. Once the condensate travels between the ridges upon the inclined bottom surface of the treatment chamber 48, it is released through discharge assembly 50 for a useful application, such as but not limited to swimming pool refill, cleaning, pressure washing, and/or other gray water uses. While in the most preferred embodiment 2 of the present invention an internal double P-trap configuration is contemplated within housing 4 and additional P-traps are not considered needed for its routine use for treating the condensate generated by air conditioners in commercial and residential buildings, it is considered to be within the scope of the present invention for the internal structure of housing 4 to be changed to include at least one additional P-trap.

I claim:

1. A filter assembly for use with a gravity-assisted water saver system that sanitizes condensate from an air conditioning system with vapors released from dissolvable tablets, such as those used for treating swimming pool water or laundering purposes, said filter assembly comprising:

a housing having a bottom end, a fluid inlet opening, and a fluid discharge opening, said fluid discharge opening being positioned lower in height than said inlet opening for gravity-assisted fluid flow from said inlet opening to said discharge opening, said housing further having internal structure providing vapor-blocking means that is selected from a group consisting of P-traps, valves and valve seats, float balls and valve seats;

a removable bottom cover having a leak-proof connection to said bottom end of said housing; and a connecting brace configured for securely fixing said housing against the treatment chamber of a gravity-assisted water saver system that sanitizes condensate from an air conditioning system with vapors released from dissolvable tablets so that when water levels within said housing are low, said vapor-blocking means prevents vapor released by the dissolvable tablets from backing up into the air conditioning system from which the treated condensate was originally collected.

2. The filter assembly of claim 1 wherein said housing also has an outer wall and a downwardly extending inner wall at a spaced-apart distance from said outer wall, and wherein said inner wall extends beyond said bottom end of said housing and forms a portion of one said P-trap.

3. The filter assembly of claim 2 wherein said bottom cover has an upwardly extending inner wall member and wherein said inner wall member is positioned within said downwardly extending inner wall of said housing when said housing and said bottom cover are joined, and wherein said upwardly extending inner wall member forms a portion of the same said P-trap containing said downwardly extending inner wall of said housing.

4. The filter assembly of claim 1 wherein said bottom cover has an upwardly extending inner wall member and wherein said inner wall member forms a portion of one said P-trap.

5. The filter assembly of claim 1 wherein said connecting brace has a downwardly extending protuberance that forms a portion of one said P-trap.

6. The filter assembly of claim 1 wherein said bottom cover has at least one ridge configured for assistance in hand manipulation during rotation of said bottom cover during removal from or attachment of said bottom cover to said housing.

7. The filter assembly of claim 1 wherein said discharge opening is formed through said housing in a position under said connecting brace.

8. The filter assembly of claim 1 wherein said housing has an upper surface and said inlet opening is positioned through said upper surface.

9. The filter assembly of claim 1 wherein said bottom cover is attached to said bottom end of said housing via a threaded connection.

10. The filter assembly of claim 1 having a float ball and valve seat and wherein said float ball and valve seat are centrally located within said housing.

11. The filter assembly of claim 1 having two P-traps, a float ball, and a valve seat, and wherein said float ball and valve seat are positioned within said housing between said P-traps.

12. The filter assembly of claim 1 further comprising an attachment member outwardly extending from said housing, said attachment member configured to provide fluid communication between said housing and an associated water saver system.

13. The filter assembly of claim 1 wherein said housing has a top surface with a recess therein, and wherein said connecting brace is configured for leak proof positioning within said recess.

14. The filter assembly of claim 13 wherein said recess has a bottom surface and an upwardly extending partition, and said partition and said bottom surface of said recess form a portion of one said P-trap.

* * * * *